US005727463A

United States Patent [19]

Deschner et al.

[11] Patent Number: 5,727,463

[45] Date of Patent: Mar. 17, 1998

[54] INK FOUNTAIN FOR OFFSET OR LETTERPRESS PRINTING PRESSES

[75] Inventors: Jürgen Deschner, St.-Leon-Rot.; Jürgen Fürbass, Nussloch, both of Germany

[73] Assignee: Heidelberger Druckmaschinen Aktiengesellschaft, Heidelberg, Germany

[21] Appl. No.: 680,570

[22] Filed: Jul. 12, 1996

[30] Foreign Application Priority Data

Jul. 15, 1995 [DE] Germany ..... 195 25 849.5

[51] Int. Cl.[6] ..... B41F 31/02

[52] U.S. Cl. ..... 101/365

[58] Field of Search ..... 101/365

[56] References Cited

U.S. PATENT DOCUMENTS

| | | | |
|---|---|---|---|
| 1,862,744 | 6/1932 | Fankboner | 101/365 |
| 2,399,688 | 5/1946 | Metzner et al. | 101/364 |
| 2,666,386 | 1/1954 | Jovishoff et al. | 101/364 |
| 3,318,239 | 5/1967 | Wintzer | 101/364 |
| 3,457,858 | 7/1969 | Gibbs | 101/363 |
| 4,242,958 | 1/1981 | Jeschke | 101/365 |
| 4,406,224 | 9/1983 | Hajek | 101/365 |
| 5,383,395 | 1/1995 | Buschulte | 101/365 |

FOREIGN PATENT DOCUMENTS

| | | |
|---|---|---|
| 2625623 | 12/1977 | Germany . |
| 2648098 | 5/1978 | Germany . |
| 2711553 | 9/1978 | Germany . |
| 4315595 | 11/1994 | Germany . |
| 1560160 | 1/1980 | United Kingdom . |

*Primary Examiner*—Edgar S. Burr
*Assistant Examiner*—Leslie Grohusky
*Attorney, Agent, or Firm*—Nils H. Ljungman and Associates

[57] ABSTRACT

An ink fountain for offset or letterpress printing presses is taught. The ink fountain has an ink dosing device with dosing elements which can be set to zonally different ink gap thicknesses on an ink ductor roller. The dosing elements are covered by an elastic film. An ink chamber is closed on both ends with closures. The two closures are connected by a cross arm to which cross arm the elastic film is fastened.

6 Claims, 1 Drawing Sheet

INK FOUNTAIN FOR OFFSET OR LETTERPRESS PRINTING PRESSES

BACKGROUND OF THE INVENTION

1. Field of the Invention

This invention relates to an ink fountain for offset or letterpress printing presses, with an ink dosing device with dosing elements which can be adjusted to zonally different ink gap thicknesses on a ductor or fountain roller, which dosing elements are covered by an elastic film, and the ink fountain has closures which close the ink chamber on both ends.

2. Background Information

In one similar known ink fountain (German Patent No. 26 48 098 C3 which corresponds to U.S. Pat. No. 4,242,958), the elastic foil covers the dosing elements and the ink fountain over their entire width, so that the printing ink, once it has been loaded into the ink fountain, cannot get under the film even when the ink is at its highest level. The film itself can be replaced easily, but after it has been used it must be disposed of as hazardous industrial waste.

OBJECT OF THE INVENTION

The object of the invention is to reduce the cost of the film itself and the cost of its disposal, and to reduce the volume of ink in the ink fountain.

SUMMARY OF THE INVENTION

The invention teaches that this object can be accomplished by connecting the two end closures by means of a cross arm which restricts the ink chamber with respect to the ink ductor roller, and by fastening the elastic film to the cross arm. This solution makes it possible to significantly reduce the width of the film, which means that the cost of the film can also be reduced. There is also less material which must be disposed of, which results in a further cost reduction. As a result of the restricted ink chamber, a job change can be performed more rapidly, and fresh printing ink is continuously supplied to the ink ductor roller. The invention also has a favorable effect on the operations required to load the ink and to check the level of ink in the ink fountain.

In other words, the known ink fountains allow the ink level to be contained by an inclined surface of the ink chamber. Thus, elastic film must cover the entire width of the ink chamber, to contain the ink in the rather wide ink chamber. The present invention teaches that a cross arm can be fastened to the end closures of the ink chamber, to reduce the width of the ink chamber so that the elastic film required is relatively narrow and the volume of ink required to achieve the proper level of ink in the ink chamber is reduced.

In one advantageous embodiment, there is a clamping strip on the cross arm which is used to clamp the elastic film in place. It thereby becomes possible to change the film in an extremely short time, and after the ink chamber has been emptied, the two closures, along with the cross arm and the film which is fastened to it, can be easily removed from the ink fountain, and the cross arm can be provided with a new film. The handling operations are thereby made significantly simpler, and the amount of work involved in cleaning, e.g. when the ink is changed, is significantly reduced.

One feature of the invention resides broadly in an ink fountain for a printing press, the ink fountain comprising: ink dosing elements to zonally vary an ink gap thickness on an ink ductor roller; and an ink chamber for holding ink; the ink chamber comprising: a first end and a second end; a width dimension extending substantially transverse to the ink duct roller; elastic film disposed to cover at least a portion of the ink dosing elements; a first side member for enclosing the first end of the ink cheer; a second side member for enclosing the second end of the ink chamber a cross arm connecting the first side member to the second side member; the cross arm being disposed to limit the width dimension of the ink chamber; and a fastening device fastening the elastic film to the cross arm member.

Another feature of the invention resides broadly in a ink fountain for a printing press, the ink fountain comprising: ink dosing elements to zonally vary an ink gap thickness on an ink ductor roller; and an ink chamber for holding ink; the ink chamber comprising: a first end and a second end; a width dimension extending substantially transverse to the ink duct roller; elastic film disposed to cover at least a portion of the ink dosing elements; a first side member for enclosing the first end of the ink chamber; a second side member for enclosing the second end of the ink chamber; a cross arm connecting the first side member to the second side member; the cross arm being disposed to limit the width dimension of the ink chamber; and a sealing device sealing the elastic film with the cross arm member.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

One embodiment of the invention is schematically illustrated in the accompanying drawings.

DESCRIPTION OF THE PREFERRED EMBODIMENT

Figure 1:
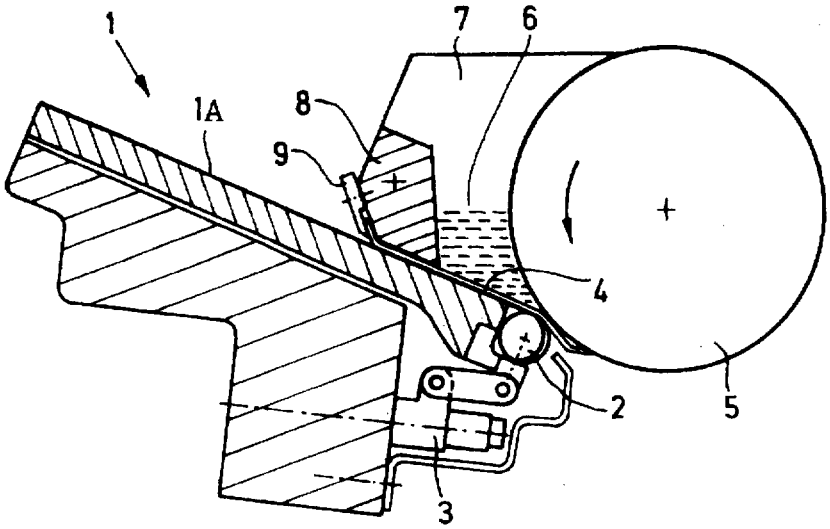
FIG. 1 shows a cross section through the ink fountain.

The ink fountain 1 with an inclined ink trough element 1A is provided over its length with a number of zonal dosing elements 2 which can be controlled by ink dosing devices 3. The dosing elements 2 can be adjusted to thereby adjust an elastic film 4 with respect to an ink ductor roller 5 to set different thicknesses of the ink gap. The ink chamber 6 is limited on both ends by closures 7 which are sealed with respect to the ink ductor roller 5. The two closures 7 are non-detachably connected to one another by means of a cross arm 8 which limits the ink cheer 6 with respect to the ink ductor roller 5, so that only a relatively small supply of ink is required. The two closures 7 with the cross arm 8 are fastened to the ink fountain 1 in a known manner such as disclosed in U.S. Pat. No. 3,318,239, FIGS. 3 and 4.

The elastic film 4 is threaded between the ink fountain 1 and the cross arm 8, and is clamped in place on the cross arm 8 on the side opposite the ink chamber 6 by means of a clamping strip 9. Clamping the elastic film 4 to the cross arm 8 prevents any escape of the ink from the ink chamber 6. On both sides, the elastic film 4 extends to underneath the closures 7, so that here, too, there is a secure sealing of the ink chamber 6. After the fastening mechanism of the two closures 7 has been released, the complete unit, consisting of the two closures 7, the cross arm 8, the film 4 and the clamping strip 9, can be easily removed from the machine, so that cleaning operations can be performed, or the film can be replaced, outside the machine. For this purpose, after the ink has been emptied, the ink fountain 1 can be pivoted from the ink ductor roller 5 in a known manner. To seal the two closures 7, the two closures 7 can be placed in contact with the ink ductor roller 5.

Figure 2:
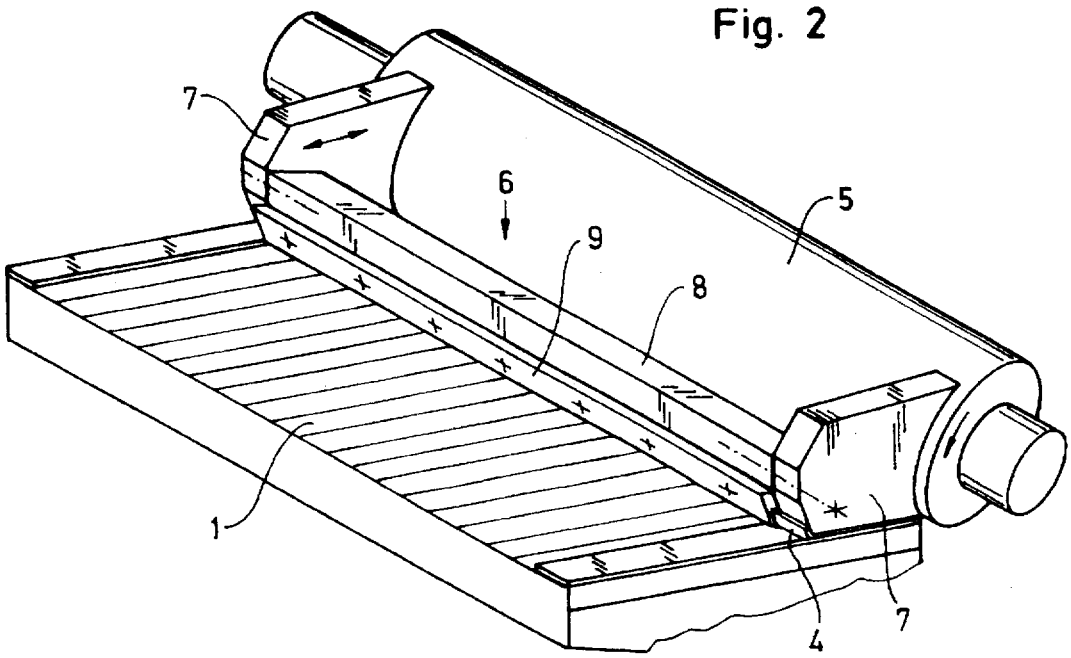
FIG. 2 shows an overhead view of the ink fountain.

The clamping strip 9 can be attached to the cross arm 8 with screws. FIG. 2 shows several crosses along the length of the clamping strip 9, which crosses can represent screws holding the clamping strip 9 to the cross arm 8. FIG. 1 shows a center line passing through the clamping strip 9 into the cross arm 8, which center line can represent the path of a screw holding the clamping strip 9 to the cross arm 8. The clamping strip 9 can be designed to hold the film 4 by tightening the screws in clamping strip 9, thereby pinching the film 4 securely in place. Alternatively, the clamping strip 9 can manufactured to be flexible or spring loaded to allow introducing the film 4 into the clamping strip 9, so that the film 4 is held securely in the clamping strip 9 without the adjustment of the screws.

The closures 7 can be attached to the cross arm 8 with screws. FIG. 2 shows a cross on the closure 7, through which cross passes a center line into the cross arm 8; the cross and center line can represent a screw holding the closure 7 to the cross arm 8.

The cross arm 8 is located adjacent to the ink ductor roller 5, thereby limiting and reducing the width dimension of the ink chamber 6. The ink in the ink chamber 6 can contact the cross arm 8 when the ink level in the ink chamber 6 is at the higher levels in the range of possible ink levels. The volume of ink required to maintain a desired ink level in the ink chamber 6 is also limited and reduced by the cross arm 8.

In addition to fastening the film 4 to the cross arm 8, the clamping strip 9 has the function of sealing between the film 4 and the cross arm 8. The seal can be created when the clamping strip 9 holds the film 4 tightly.

There is preferably no leaking of ink from the ink chamber 6. Ink leakage is preferably prevented between the closures 7 and the ink ductor roller 5 by placing the closures 7 in contact with the ink ductor roller 5 to prevent leaking of ink but at the same time to allow rotation of the ink ductor roller 5. In addition, the film 4 is preferably held between the closures 7 and the ink fountain 1 to prevent leakage of ink between the film 4 and closures 7. The closures 7 can be held in position to prevent leakage by clamping the closures 7 to the ink fountain 1 as shown in U.S. Pat. No. 3,318,239 in FIGS. 3 and 4. The attachment of the cross arm 8 to the closures 7 preferably prevents ink leakage therebetween. The clamping strip 9 preferably prevents ink leakage between the film 4 and the cross arm 8, and the clamping strip 9 can also prevent ink leakage between the film 4 and the closures 7, especially at the ends of the clamping strip 9.

One feature of the invention resides broadly in the ink fountain for offset or letterpress printing machines, with an ink dosing device with dosing elements which can be set to zonally different ink gap thicknesses on an ink ductor roller, which dosing elements are covered by an elastic film and with closures which close the ink cheer on both ends, characterized by the fact that—the two closures 7 are connected by a cross arm 8, which restricts the ink cheer 6 with respect to the ink ductor roller 5 and—the elastic film 4 is fastened to the cross arm 8.

Another feature of the invention resides broadly in the ink fountain characterized by the fact that on the cross arm 8 there is a clamping strip 9 to clamp the elastic film 4.

Examples of ink fountains can be found in the following U.S. Pat. Nos. 5,201,271; 5,205,216; 5,230,286; 5,279,223; 5,280,750; 5,289,772; and 5,327,830.

An example of an ink fountain which has ink dosing elements can be found in U.S. Pat. No. 4,242,958.

Examples of clamping devices can be found in the following U.S. Pat. Nos. 5,248,542; 5,361,698; 5,184,554; and 5,192,062.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 25 849.5, filed on Jul. 15, 1995, having inventors Jürgen Deschner and Jürgen Fürbass, and DE-OS 195 25 849.5 and DE-PS 195 25 849.5, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. An ink fountain for a printing press, said ink fountain comprising:

ink dosing elements to zonally vary an ink gap thickness on an ink duct roller;

an inclined ink trough element;

said inclined ink trough element comprising an inclined ink trough surface;

said inclined ink trough surface being disposed towards the ink duct roller; and an ink chamber for holding ink;

said ink chamber comprising:

a first end and a second end;

a first side member for enclosing the first end of said ink chamber;

a second side member for enclosing the second end of said ink chamber;

an apparatus to minimize the volume of ink contained in said ink chamber, said apparatus including a cross am connecting said first side member to said second side member; and a fastening device carried by said cross arm being configured to fasten an elastic film to said cross arm;

said ink chamber being configured to contain ink at an ink level which ink level has an ink surface at the ink level, the ink surface having a width dimension extending substantially transverse to the ink duct roller;

the ink surface defining a plane disposed on the ink surface, the plane extending from the ink duct roller to said inclined ink trough surface, and the plane having a width dimension extending from the ink duct roller to said inclined ink trough surface; and said cross arm being disposed to limit the width dimension of said ink chamber and disposed to minimize the width of an elastic film being fastened to and extending from said fastening device and disposed to restrict the width dimension of the ink surface extending from the ink duct roller to said cross arm to a dimension substantially smaller than the width dimension of the plane.

2. The ink fountain of claim 1, wherein:

said fastening device comprises a clamping strip.

3. An ink fountain for a printing press, said ink fountain comprising:

ink dosing elements to zonally vary an ink gap thickness on an ink duct roller;

an inclined ink trough element;

said inclined ink trough element comprising an inclined ink trough surface having a width dimension extending substantially transverse to a rotational axis of the ink duct roller from said ink duct roller to said inclined trough element;

said inclined ink trough surface being disposed towards the ink duct roller; and an ink chamber for holding ink;

said ink chamber comprising:

a first end and a second end;

a width dimension extending substantially transverse to the rotational axis of the ink duct roller;

a first side member for enclosing said first end of said ink chamber;

a second side member for enclosing said second end of said ink chamber;

an apparatus to minimize the volume of ink contained in said ink chamber, said apparatus including a cross arm connecting said first side member to said second side member;

said cross arm being disposed to limit the width dimension of ink contained in said ink chamber to a dimension substantially smaller than the width dimension of said inclined ink trough surface; and a fastening device carried by said cross arm being configured to fasten an elastic film to said cross arm.

4. The ink fountain of claim 3, wherein:

said fastening device comprises a clamping strip.

5. An ink fountain for a printing press, said ink fountain comprising:

ink dosing elements to zonally vary an ink gap thickness on an ink duct roller;

an inclined ink trough element;

said inclined ink trough element comprising an inclined ink trough surface having a width dimension extending substantially transverse to a rotational axis of the ink duct roller from said ink duct roller to said inclined trough element;

said inclined ink trough surface being disposed towards the ink duct roller; and an ink chamber for holding ink;

said ink chamber comprising:

a first end and a second end;

a width dimension extending substantially transverse to the rotational axis of the ink duct roller;

a first side member for enclosing the first end of said ink chamber;

a second side member for enclosing the second end of said ink chamber;

an apparatus to minimize the volume of ink contained in said ink chamber, said apparatus including a cross arm connecting said first side member to said second side member to form a removable unit;

said removable unit comprising said crossarm and said first and second side members;

said cross arm being disposed to limit the width dimension of said ink chamber; and a fastening device carried by said cross arm being configured to fasten an elastic film to said cross arm.

6. The ink fountain of claim 5, wherein:

said fastening device comprises a clamping strip.

* * * * *

UNITED STATES PATENT AND TRADEMARK OFFICE

CERTIFICATE OF CORRECTION

PATENT NO. : 5,727,463

DATED : March 17, 1998

INVENTOR(S) : Jürgen DESCHNER and Jürgen FÜRBASS

It is certified that error appears in the above-identified patent and that said Letters Patent is hereby corrected as shown below:

In column 2, line 4, after 'ink', delete "cheer;" and insert --chamber;--.

In column 2, line 58, after 'ink', delete "cheer" and insert --chamber--.

In column 3, line 65, after 'ink', delete "cheer" and insert --chamber--.

In column 3, line 67, after 'ink', delete "cheer" and insert --chamber--.

Signed and Sealed this

First Day of September, 1998

Bruce Lehman

*Attest:*

BRUCE LEHMAN

*Attesting Officer*

*Commissioner of Patents and Trademarks*